US007141341B2

(12) United States Patent
Sekido et al.

(10) Patent No.: US 7,141,341 B2
(45) Date of Patent: Nov. 28, 2006

(54) ELECTROPHOTOGRAPHIC PHOTOSENSITIVE MEMBER, PROCESS CARTRIDGE, AND ELECTROPHOTOGRAPHIC APPARATUS

(75) Inventors: Kunihiko Sekido, Numazu (JP); Hideaki Nagasaka, Sunto-gun (JP); Michiyo Sekiya, Mishima (JP); Nobumichi Miki, Suntoh-gun (JP); Yosuke Morikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/064,082

(22) Filed: Feb. 24, 2005

(65) Prior Publication Data

US 2005/0142472 A1 Jun. 30, 2005

Related U.S. Application Data

(63) Continuation of application No. PCT/JP04/019761, filed on Dec. 24, 2004.

(30) Foreign Application Priority Data

Dec. 26, 2003 (JP) ..... 2003-434016

(51) Int. Cl.
*G03G 5/047* (2006.01)

(52) U.S. Cl. ..... 430/58.05; 399/159

(58) Field of Classification Search ..... 430/58.05; 399/159

See application file for complete search history.

(56) References Cited

U.S. PATENT DOCUMENTS

| | | | | |
|---|---|---|---|---|
| 4,888,261 | A * | 12/1989 | Mabuchi | 430/56 |
| 4,963,452 | A | 10/1990 | Kinoshita | 430/78 |
| 5,087,540 | A | 2/1992 | Murakami et al. | 430/58 |
| 5,376,487 | A * | 12/1994 | Ueda | 430/58.75 |
| 5,389,477 | A * | 2/1995 | Tsuchiya et al. | 430/58.15 |
| 5,834,146 | A | 11/1998 | Hoshizaki et al. | 430/59 |
| 6,002,901 | A | 12/1999 | Hoshizaki et al. | 399/159 |
| 6,242,144 | B1 * | 6/2001 | Lin et al. | 430/58.4 |
| 6,586,148 | B1 * | 7/2003 | Graham et al. | 430/58.65 |

FOREIGN PATENT DOCUMENTS

| | | |
|---|---|---|
| JP | 01-169454 | 7/1989 |
| JP | 03-287171 | 12/1991 |
| JP | 06-313974 | 11/1994 |
| JP | 07-104495 | 4/1995 |
| JP | 09-096914 | 4/1997 |
| JP | 2000-019746 | 1/2000 |
| JP | 2000-039730 | 2/2000 |
| JP | 2001-040237 | 2/2001 |

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member superior in dot reproducibility and a process cartridge and an process cartridge having the electrophotographic photosensitive member are provided. Where in a light attenuation curve drawn in a way in which the surface of the electrophotographic photosensitive member is so charged that intensity of an electric field is 15 (V/μm) to establish the surface potential of the electrophotographic photosensitive member into a given value E(V) and then exposed to light under conditions that the electrophotographic photosensitive member has a surface potential of 0.8 E(V) at a time point T(ms) passes after exposure starts, the inclination of the light attenuation curve at a time point T(ms) passes after exposure starts is represented by m, and in a dark-time surface potential attenuation curve drawn in a way in which the surface of the electrophotographic photosensitive member is charged under conditions that the electrophotographic photosensitive member has a surface potential of 0.8 E(V) at a time point T(ms) passes after charging is finished and thereafter no exposure is performed, the inclination of the dark-time surface potential attenuation curve at a time point T(ms) passes after charging is finished is represented by m', the m and m' satisfy $|m-m'| \leqq 0.020$, provided that $T=[\{d^2/(\mu \times E)\} \times 100] \times 10^{-5}$, where d is the layer thickness (μm) of the charge transport layer and μ is the drift mobility [$cm^2/(V \cdot s)$] of the charge transport layer.

9 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2004/019761, filed on Dec. 24, 2004, which claims the benefit of Japanese Patent Application No. 2003-434016 filed on Dec. 26, 2003.

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

Various systems such as an electrophotographic system, a thermal transfer system and an ink-jet recording system have been employed in image forming apparatus. Of these, image forming apparatus employing the electrophotographic system are superior to image forming apparatus employing the other systems, in view of higher speed, higher image quality and less noise, and are employed in many copying machines and printers.

Image formation by the electrophotographic system is performed by a process in which the surface of an electrophotographic photosensitive member is electrostatically charged, the surface of the electrophotographic photosensitive member thus charged is exposed to exposure light to form an electrostatic latent image on the surface of the electrophotographic photosensitive member, this electrostatic latent image is developed with a toner (a developer) to form a toner image on the surface of the electrophotographic photosensitive member, and this toner image is transferred from the surface of the electrophotographic photosensitive member to a transfer material such as paper.

At present, laser light is widely used as the above exposure light. Where laser light is used as exposure light, the electrostatic latent image formed on the surface of the electrophotographic photosensitive member is formed as a digital electrostatic latent image (a digital latent image).

As the electrophotographic photosensitive member, widely used is an electrophotographic photosensitive member (an organic electrophotographic photosensitive member) having a photosensitive layer containing an organic charge-generating material and a charge-transporting material. As such a photosensitive layer, from the viewpoint of durability, what is prevalent is one having layer configuration of a multi-layer type (regular-layer type) in which a charge generation layer containing a charge-generating material and a charge transport layer containing a charge-transporting material are superposed in this order from the support side.

In these days, the progress of electrophotographic technique is remarkable, and electrophotographic photosensitive members are also required to have high performance. In particular, the performance that deals with higher image quality has become strongly demanded.

As the reason that such higher image quality is demanded, it is cited that the electrophotographic technique has, in virtue of their on-demand availability, advanced into the market that has belonged to printing techniques such as offset printing and screen printing. Accordingly, a high image quality on the level of that in printing techniques is demanded in respect of reproducibility of small-point characters and photographic images, in particular, reproducibility of halftone images.

However, in the printing techniques such as offset printing and screen printing, the shape of a plate is faithfully reproduced, whereas in the electrophotographic technique, especially when laser light is used as exposure light, there is a problem concerning deterioration of dot reproducibility, i.e., a problem such that not only dots on the electrophotographic photosensitive member surface but dots on reproduced images are inevitably enlarged as compared with laser beam spots. It is considered that the dots of electrostatic latent images formed on the surface of the electrophotographic photosensitive member are shallower and broader in their three-dimensional shapes. Also, this problem is remarkable where the dots are contiguous to each other.

As a technique by which the dot reproducibility is improved, an induction photosensitive member is disclosed in, e.g., Japanese Patent Applications Laid-open No. H01-169454, No. H03-287171 and No. H09-096914, in which its potential does not attenuate until reaching a certain amount of exposure light and steep attenuation of potential takes place when exceeding that amount of exposure light.

SUMMARY OF THE INVENTION

The induction photosensitive member has superior single-dot reproducibility. However, where the dots are contiguous to each other, the steep attenuation of potential takes place also at dots overlapping areas (areas where exposure has overlapped between dots), so that the dot reproducibility may deteriorate.

Nowadays, manufactures having a high resolution of 600 dpe to 1,200 dpi, and further 1,200 dpi to 2,400 dpi are on the market, and aftertime, they are expected to have much higher resolution. At present, in electrophotographic apparatus making use of widely prevailing infrared semiconductor lasers, laser beams have a spot diameter of about 60 to 80 μm, whereas dot-to-dot distance at 600 dpi is 42 μm; at 1,200 dpi, 21 μm; and at 2,400 dpi, 10.5 μm. Hence, the overlapping of dots becomes conspicuous.

Use of electrophotographic photosensitive members having good dot reproducibility leads to not only improvement in resolution but also improvement in gradation.

Accordingly, an object of the present invention is to provide an electrophotographic photosensitive member promising a superior dot reproducibility, and a process cartridge and an process cartridge which have such an electrophotographic photosensitive member.

As a result of extensive studies, the present inventors have discovered that the above object can be achieved by the use of an electrophotographic photosensitive member whose rate of attenuation of potential on a lapse of a certain time after exposure is kept at a specific value or less.

More specifically, the present invention is an electrophotographic photosensitive member comprising a support, a charge generation layer containing a charge-generating material, provided on the support, and a charge transport layer containing a charge-transporting material, provided on the charge transport layer, wherein:

where in a light attenuation curve drawn in a way in which the surface of the electrophotographic photosensitive member is so charged that intensity of an electric field applied to the electrophotographic photosensitive member is 15 (V/μm) to establish a surface potential of the electrophotographic photosensitive member into a given value E(V) and subsequently the surface of the electrophotographic photosensitive member is exposed to light under conditions that the electrophotographic photosensitive member has a surface potential of 0.8 E(V) at a time point that T(ms) passes after exposure starts, an inclination of the light attenuation curve at a time point that T(ms) passes after exposure starts is represented by m, and in a dark-time surface potential attenuation curve drawn in a way in which the surface of the electrophotographic photosensitive member is charged under conditions that the electrophotographic photosensitive member has a surface potential of 0.8 E(V) at a time point that T(ms) passes after charging is finished and thereafter no exposure is performed, an inclination of the dark-time surface potential attenuation curve at a time point that T (ms) passes after charging is finished is represented by m', m and m' satisfy the following expression (I):

$$|m-m'|\leqq 0.020 \quad \text{(I)},$$

provided that $T=((d^2/(\mu\times E))\times 100)\times 10^{-5}$ where d is a layer thickness (μm) of the charge transport layer and μ is a drift mobility [$cm^2/(V\cdot s)$] of the charge transport layer.

The present invention is also a process cartridge and an electrophotographic apparatus which have the above electrophotographic photosensitive member.

According to the present invention, an electrophotographic photosensitive member can be provided ensuring superior dot reproducibility and thereby forming character images superior in sharpness, and a process cartridge and an electrophotographic apparatus can be provided having such an electrophotographic photosensitive member.

DESCRIPTION OF THE PREFERRED EMBODIMENTS

The present invention is described below in detail.

Described first is a judgement method by which judgement is made on whether or not a electrophotographic photosensitive member satisfies the above condition of the present invention (hereinafter referred to also as "judgement method of the present invention").

The judgement method of the present invention is conducted in an environment of normal temperature and normal humidity (23° C., 50% RH).

In the present invention, as stated above, when the inclination of a light attenuation curve at a time point that T(ms) passes after exposure starts is represented by m where the light attenuation curve is drawn in a way in which the surface of the electrophotographic photosensitive member is so charged that the intensity of an electric field applied to the electrophotographic photosensitive member is 15 (V/μm) to set the surface potential of the electrophotographic photosensitive member at a given value E(V) and subsequently the surface of the electrophotographic photosensitive member is exposed to light under the conditions that the electrophotographic photosensitive member have a surface potential of 0.8 E(V) at a time point that T (ms) passes after exposure starts, and the inclination of a dark-time surface potential attenuation curve at a time point that T(ms) passes after charging is finished is represented by m' where the dark-time surface potential attenuation curve is drawn in a way in which the surface of the electrophotographic photosensitive member is charged under the conditions that the electrophotographic photosensitive member have a surface potential of 0.8 E(V) at a time point that T(ms) passes after charging is finished and thereafter no exposure is performed, m and m' satisfy the following expression (I):

$$|m-m'|\leqq 0.020 \quad \text{(I)}.$$

The "T(ms)" is defined by "$[\{d^2/(\mu\times E)\}\times 100]\times 10^{31\ 5}$" where the layer thickness (μm) of the charge transport layer of the electrophotographic photosensitive member is represented by d (μm) and the drift mobility of the charge transport layer is represented by μ [$cm^2/(V\cdot s)$]. Letter symbols d, μ and E are constants, and hence T is also a constant.

Figure 1:
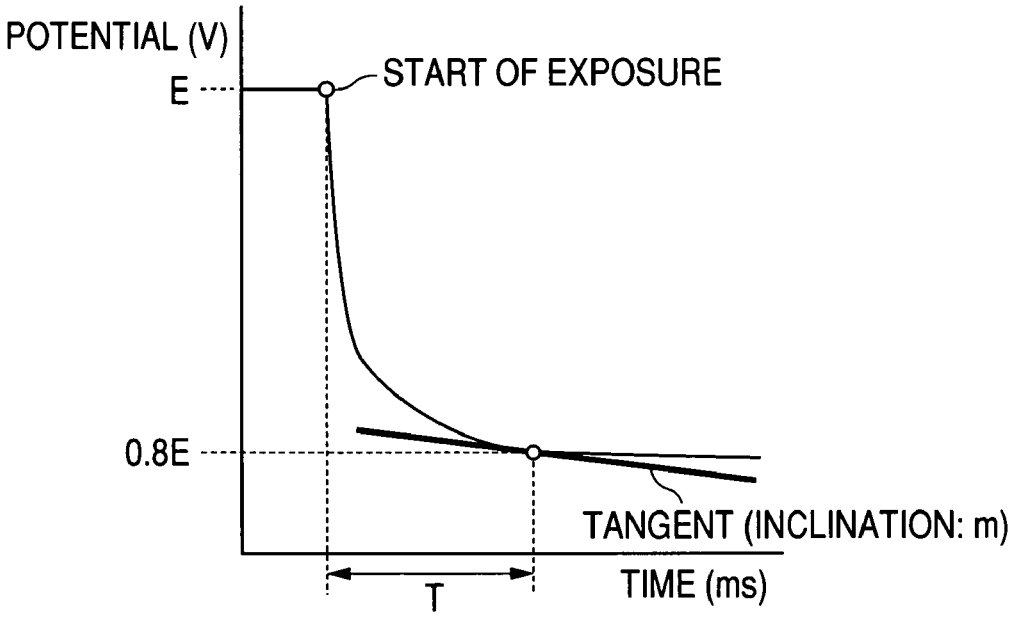
FIG. 1 is a view for explaining "m".
Figure 2:
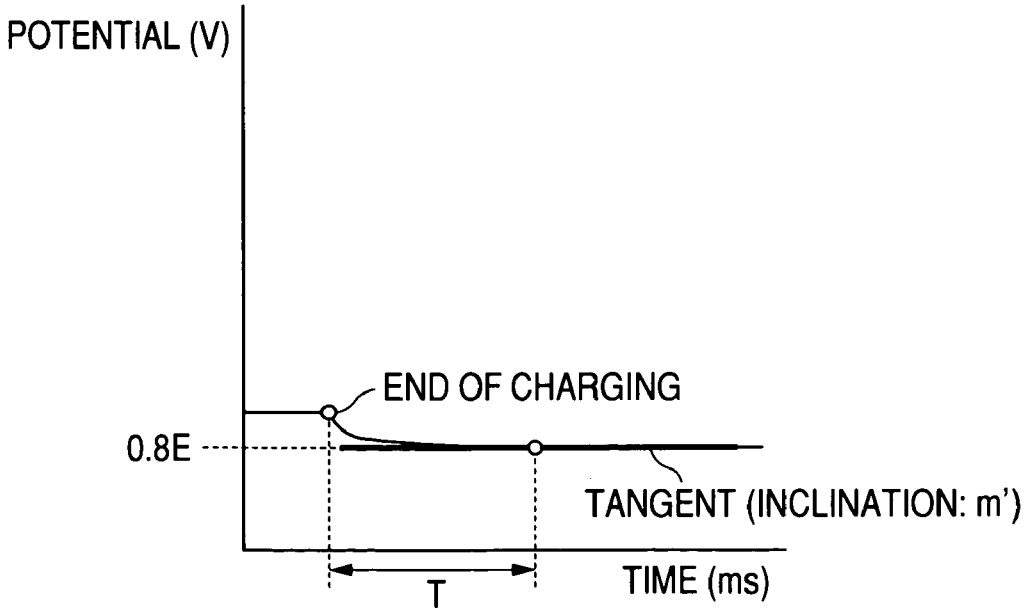
FIG. 2 is a view for explaining "m'".

FIG. 1 is a view for explaining "m", and FIG. 2 is a view for explaining "m'".

In the present invention, the value of |m−m'| is 0.020 or less. It may preferably be 0.015 or less, and, in particular, more preferably be from 0.001 or more to 0.015 or less.

Electric charges generated in the charge generation layer are injected into the charge transport layer. In the charge transport layer, they are transported to the surface of the electrophotographic photosensitive member. Some electric charges come to the surface of the electrophotographic photosensitive member in a short time, and some electric charges take a relatively long time to come to the surface of the electrophotographic photosensitive member. The present inventors have considered that dots are first formed by the electric charges having come to the surface of the electrophotographic photosensitive member in a short time and thereafter the electric charges having taken a relatively long time to come to the surface of the electrophotographic photosensitive member (i.e., delayed electric charges) disturb the first formed dots to lower the dot reproducibility. As to the above |m−m'|, it means that, the smaller the value is, the less the delayed electric charges are.

The attenuation of potential that is not due to light, such as injection of holes from the support into the charge generation layer, i.e., the inclination m' of the dark-time surface potential attenuation also participates in the inclination m of light attenuation, shown in FIG. 1. Therefore, the value found by subtracting m' from m, |m−m'|, is the inclination of precise light attenuation.

In the present invention, the m and m' are measured with a modified machine of a drum tester CYNTHIA 90, manufactured by Gen-Tech, Inc. As a light source, used is LD (chip: SLD344YT, manufactured by Sony Corp; driver: ALP7204PA, manufactured by Asahi data systems Ltd.; pulse width: 2 μs). Data of potential are inputted to a digital oscilloscope 54710A, manufactured by Hewlett-Packard Co, by the use of which the potential attenuation curve is drawn and the values of m and m' are calculated.

The constitution of the electrophotographic photosensitive member of the present invention is described below.

As mentioned above, the electrophotographic photosensitive member of the present invention is an electrophotographic photosensitive member comprising a support, a charge generation layer containing a charge-generating material, provided on the support, and a charge transport layer containing a charge-transporting material, provided on the charge transport layer.

The charge transport layer of the electrophotographic photosensitive member of the present invention may be a hole transport layer containing a hole-transporting material or an electron transport layer containing an electron-transporting material. In the case where the charge transport layer provided on the charge generation layer is the hole transport layer, the electrophotographic photosensitive member is a negative-charge type electrophotographic photosensitive member. In the case where it is the electron transport layer, the electrophotographic photosensitive member is a positive-charge type electrophotographic photosensitive member. From the viewpoint of electrophotographic performance, the charge transport layer provided on the charge generation layer may preferably be the hole transport layer.

In the following, the electrophotographic photosensitive member is primarily described taking as an example a case in which the charge transport layer is the hole transport layer.

As the support, it is sufficient to have conductivity (conductive support). For example, usable are supports made of a metal (or made of an alloy) such as aluminum, nickel, copper, gold, iron, aluminum alloy or stainless steel. Also usable are supports made of the above metal, a plastic (such as polyester resin, polycarbonate resin or polyimide resin) or glass, and having a layer formed by vacuum deposition of aluminum, aluminum alloy, indium oxide-tin oxide alloy or the like. Still also usable are supports composed of plastic or paper impregnated with conductive fine particles such as carbon black, tin oxide particles, titanium oxide particles or silver particles together with a suitable binder resin, and supports made of a plastic containing a conductive binder resin. As the shape of the support, it may include a cylinder, a belt, etc. A cylindrical support is preferred.

For the purpose of preventing interference fringes caused by scattering of laser light or the like, the surface of the support may be subjected to cutting, surface roughening (such as honing or blasting) or aluminum anodizing, or may be subjected to chemical treatment with a solution prepared by dissolving a metal salt compound or a metal salt of a fluorine compound in an acid aqueous solution containing as a main component an alkali phosphate, phosphoric acid or tannic acid.

The honing includes dry honing and wet honing. The wet honing is a method in which a powdery abrasive is suspended in a liquid such as water and the suspension obtained is sprayed on the surface of the support at a high speed to roughen the surface of the support, where surface roughness may be controlled by selecting spray pressure or speed, the type, shape, size, hardness or specific gravity of the abrasive, suspension temperature, and so forth. The dry honing is a method in which an abrasive is sprayed by air on the surface of the support at a high speed to roughen the surface of the support, where surface roughness may be controlled in the same way as the wet honing. The abrasive used in the honing may include particles of silicon carbide, alumina, iron, and glass beads.

A conductive layer intended for the prevention of interference fringes caused by scattering of laser light or the like or for the covering of scratches of the support surface may be provided between the support and the charge generation layer or an intermediate layer described later.

The conductive layer may be formed by coating the support with a dispersion prepared by dispersing conductive particles such as carbon black, metal particles or metal oxide particles in a binder resin. Preferable metal oxide particles may include particles of zinc oxide and titanium oxide. Also, as the conductive particles, particles of barium sulfate may be used. The conductive particles may be provided with coat layers.

The conductive particles may preferably have volume resistivity in the range of from 0.1 to 1,000 Ω·cm and more preferably in the range of from 1 to 1,000 Ω·cm (This volume resistivity is the value determined by using a resistance meter LORESTA AP, manufactured by Mitsubishi Chemical Corporation. A sample for measurement is one solidified at a pressure of 49 MPa to be in the form of a coin.). Also, the conductive particles may preferably have average particle diameter in the range of from 0.05 μm to 1.0 μm, and more preferably in the range of from 0.07 μm to 0.7 μm. (This average particle diameter is the value measured by centrifugal sedimentation.) The proportion of the conductive particles in the conductive layer may preferably be in the range of from 1.0 to 90% by weight, and more preferably in the range of from 5.0 to 80% by weight, based on the total weight of the conductive layer.

The binder resin used in the conductive layer may include, e.g., phenol resins, polyurethane resins, polyamide resins, polyimide resins, polyamide-imide resins, polyamic acid resins, polyvinyl acetal resins, epoxy resins, acrylic resins, melamine resins and polyester resins. Any of these may be used alone or in the form of a mixture or copolymer of two or more types. These have good adhesion to the support, and also improve dispersibility of the conductive particles and have good solvent resistance after films have been formed. Of these, phenol resins, polyurethane resins and polyamic acid resins are preferred.

The conductive layer may preferably be in a layer thickness of from 0.1 μm to 30 μm, and more preferably from 0.5 μm to 20 μm.

The conductive layer may preferably have a volume resistivity of $10^{13}$ Ω·cm or less, and more preferably in the range of from $10^{5}$ to $10^{12}$ Ω·cm. (This volume resistivity is the value determined by forming a coating film on an aluminum plate by the use of the same material as the conductive layer whose volume resistivity is to be measured, forming a thin gold film on this coating film, and measuring with a pA meter the value of electric current flowing across both electrodes, the aluminum plate and the thin gold film.)

The conductive layer may optionally be incorporated with fluorine or antimony, or a leveling agent may be added to the conductive layer in order to improve its surface properties.

An intermediate layer (also called a subbing layer or an adhesion layer) functioning as a barrier and an adhesive may be provided between the support or the conductive layer and the charge generation layer. The intermediate layer is formed for the purposes of, e.g., improving the adhesion of the photosensitive layer, coating performance and the injection of electric charges from the support and protecting the photosensitive layer from electrical breakdown.

The intermediate layer may be formed using a resin such as acrylic resin, allyl resin, alkyd resin, ethyl cellulose resin, an ethylene-acrylic acid copolymer, epoxy resin, casein resin, silicone resin, gelatin resin, nylon, phenol resin, butyral resin, polyacrylate resin, polyacetal resin, polyamide-imide resin, polyamide resin, polyallyl ether resin, polyimide resin, polyurethane resin, polyester resin, polyethylene resin, polycarbonate resin, polystyrene resin, polysulfone resin, polyvinyl alcohol resin, polybutadiene resin, polypropylene resin or urea resin, or a material such as aluminum oxide.

The intermediate layer may preferably be in a layer thickness of 0.1 μm to 5 μm, and more preferably from 0.3 μm to 2 μm.

The charge-generating material used in the electrophotographic photosensitive member of the present invention may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts, thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, styryl dyes, cadmium sulfide, and zinc oxide. Any of these charge-generating materials may be used alone or in a combination of two or more types.

Of the above various charge-generating materials, azo pigments and phthalocyanine pigments are preferred in view of their high sensitivity, and phthalocyanine pigments are particularly preferred.

Of phthalocyanine pigments, metal phthalocyanine pigments are preferred. In particular, oxytitanium phthalocyanine, chlorogallium phthalocyanine, dichlorotin phthalocyanine and hydroxygallium phthalocyanine are preferred. Of these, hydroxygallium phthalocyanine is particularly preferred.

As the oxytitanium phthalocyanine, preferred are oxytitanium phthalocyanine crystals with a crystal form having strong peaks at Bragg angles 2θ±0.2° of 9.0°, 14.2°, 23.9° and 27.1° in CuKα characteristic X-ray diffraction, and oxytitanium phthalocyanine crystals with a crystal form having strong peaks at Bragg angles 2θ±0.2° of 9.5°, 9.7°, 11.7°, 15.0°, 23.5°, 24.1° and 27.3° in CuKα characteristic X-ray diffraction.

As the chlorogallium phthalocyanine, preferred are chlorogallium phthalocyanine crystals with a crystal form having strong peaks at Bragg angles 2θ±0.2° of 7.4°, 16.6°, 25.5° and 28.2° in CuKα characteristic X-ray diffraction, chlorogallium phthalocyanine crystals with a crystal form having strong peaks at Bragg angles 2θ±0.2° of 6.8°, 17.3°, 23.6° and 26.9° in CuKα characteristic X-ray diffraction, and chlorogallium phthalocyanine crystals with a crystal form having strong peaks at Bragg angles 2θ±0.2° of 8.7° to 9.2°, 17.6°, 24.0°, 27.4° and 28.8° in CuKα characteristic X-ray diffraction.

As the dichlorotin phthalocyanine, preferred are dichlorotin phthalocyanine crystals with a crystal form having strong peaks at Bragg angles 2θ±0.2° of 8.3°, 12.2°, 13.7°, 15.9°, 18.9° and 28.2° in CuKα characteristic X-ray diffraction, dichlorotin phthalocyanine crystals with a crystal form having strong peaks at Bragg angles 2θ±0.2° of 8.5°, 11.2°, 14.5° and 27.2° in CuKα characteristic X-ray diffraction, dichlorotin phthalocyanine crystals with a crystal form having strong peaks at Bragg angles 2θ±0.2° of 8.7°, 9.9°, 10.9°, 13.1°, 15.2°, 16.3°, 17.4°, 21.9° and 25.5° in CuKα characteristic X-ray diffraction, and dichlorotin phthalocyanine crystals with a crystal form having strong peaks at Bragg angles 2θ±0.2° of 9.2°, 12.2°, 13.4°, 14.6°, 17.0° and 25.3° in CuKα characteristic X-ray diffraction.

As the hydroxygallium phthalocyanine, preferred are hydroxygallium phthalocyanine crystals with a crystal form having strong peaks at Bragg angles 2θ±0.2° of 7.3°, 24.9° and 28.1° in CuKα characteristic X-ray diffraction, and hydroxygallium phthalocyanine crystals with a crystal form having strong peaks at Bragg angles 2θ±0.2° of 7.5°, 9.9°, 12.5°, 16.3°, 18.6°, 25.1° and 28.3° in CuKα characteristic X-ray diffraction.

The charge-generating material may preferably have particle diameters of 0.5 μm or less, and more preferably in the range of from 0.01 μm to 0.2 μm.

The binder resin used in the charge generation layer may include, e.g., acrylic resins, aryl resins, alkyd resins, epoxy resins, diallyl phthalate resins, silicone resins, styrene-butadiene copolymers, cellulose resins, nylons, phenol resins, butyral resins, benzal resins, melamine resins, polyacrylate resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone resins, polyvinyl acetal resins, polyvinyl methacrylate resins, polyvinyl acrylate resins, polybutadiene resins, polypropylene resins, methacrylic resins, urea resins, vinyl chloride-vinyl acetate copolymers, vinyl acetate resins and vinyl chloride resins. In particular, butyral resins are preferred. Any of these may be used alone or in the form of a mixture or copolymer of two or more types.

As one of methods for producing the electrophotographic photosensitive member that satisfies the above condition defined by the expression (I), a method is available in which the charge transport layer provided on the charge generation layer is the hole transport layer, and an electron-transporting material is incorporated in the charge generation layer.

The electron-transporting material may include, e.g., fluorenone compounds such as trinitrofluorenone, imide compounds such as pyromellitic imide and naphthyl imide, quinone compounds such as benzoquinone, diphenoquinone, diiminoquinone, naphthoquinone, stilbene quinone and anthraquinone, fluorenylidene compounds such as fluorenylidene aniline and fluorenylidene malonitrile, carboxylic anhydrides such as phthalic anhydride, cyclic sulfone compounds such as thiopyrane dioxide, oxadiazole compounds, and triazole compounds. Of these, imide compounds are preferred. In particular, naphthalene tetracarboxylic acid diimide compounds having structure represented by the following formula (1) are more preferred.

(1)

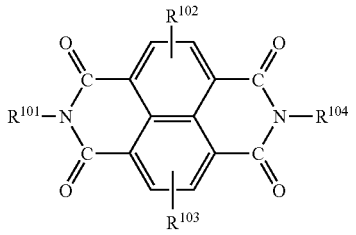

In the above formula (1), $R^{101}$ and $R^{104}$ are each independently a substituted or unsubstituted alkyl group, a substituted or unsubstituted alkyl group interrupted with an ether group, a substituted or unsubstituted alkenyl group, a substituted or unsubstituted alkenyl group interrupted with an ether group, a substituted or unsubstituted aryl group, a substituted or unsubstituted aralkyl group or a monovalent substituted or unsubstituted heterocyclic group, and $R^{102}$ and $R^{103}$ are each independently a hydrogen atom, a halogen atom, a nitro group, a substituted or unsubstituted alkyl group or a substituted or unsubstituted alkoxyl group.

The above alkyl group may include chain-like alkyl groups such as a methyl group, an ethyl group and a propyl group, and cyclic alkyl groups such as a cyclohexyl group and a cycloheptyl group. The above alkenyl group may include a vinyl group and an allyl group. The above aryl group may include a phenyl group, a naphthyl group and an anthryl group. The above aralkyl group may include a benzyl group and a phenetyl group. The above monovalent heterocyclic group may include a pyridyl group and a fural group. The above halogen atom may include a fluorine atom, a chlorine atom and a bromine atom. The above alkoxyl group may include a methoxyl group, an ethoxyl group and a propoxyl group.

The substituent each of the above groups may have may include alkyl groups such as a methyl group, an ethyl group, a propyl group and a cyclohexyl group, alkenyl groups such as a vinyl group and an allyl group, a nitro group, halogen atoms such as a fluorine atom, a chlorine atom and a bromine atom, halogenated alkyl groups such as a perfluoroalkyl group, aryl groups such as a phenyl group, a naphthyl group and an anthryl group, aralkyl groups such as a benzyl group and a phenetyl group, and alkoxyl groups such as a methoxyl group, an ethoxyl group and a propoxyl group.

Of the naphthalene tetracarboxylic acid diimide compounds having structure represented by the above formula (1), preferred are those in which at least one of $R^{101}$ and $R^{104}$ is a substituted or unsubstituted straight-chain alkyl group or a substituted aryl group. Also, of the substituted or unsubstituted straight-chain alkyl group, a straight-chain alkyl group substituted with a halogen atom is preferred, and of the substituted aryl group, an aryl group substituted with a halogen atom, an aryl group substituted with an alkyl group or an aryl group substituted with a halogenated alkyl group is preferred. Also, from the viewpoint of solubility in solvents, it is preferable that the naphthalene tetracarboxylic acid diimide compounds having structure represented by the above formula (1) have an unsymmetrical structure (e.g., $R^{101}$ and $R^{104}$ are different groups) or that a bulky group such as an alkyl group having 4 or more carbon atoms is introduced.

As the electron-transporting material to be incorporated in the charge generation layer, preferred is one whose reduction potential (reduction potential with respect to a saturated calomel electrode) is in the range of from −0.50 to −0.30 V, and more preferably in the range of from −0.50 to −0.35 V.

In the present invention, the reduction potential is measured by three-electrode cyclic voltammetry in the following way.

Measuring instrument: Voltammetric Analyzer BAS100B (manufactured by BAS Inc.).

Work electrode: A glassy carbon electrode.

Counter electrode: A platinum electrode.

Reference electrode: A saturated calomel electrode (0.1 mol/l potassium chloride aqueous solution).

Measuring solution: A solution making use of 0.001 mol of the measuring object electron-transporting material, 0.1 mol of t-butylammonium perchlorate as an electrolyte and 1 liter of acetonitrile as a solvent.

A peak top of the first reduction potential as measured is regarded as the reduction potential of the electron-transporting material.

Specific examples of the electron-transporting material are shown below.

(E-1)

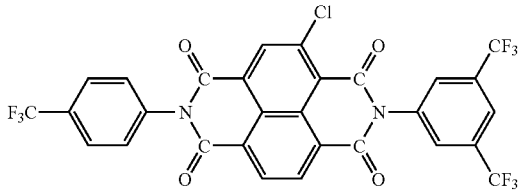

Reduction potential: -0.47 (V)

(E-2)

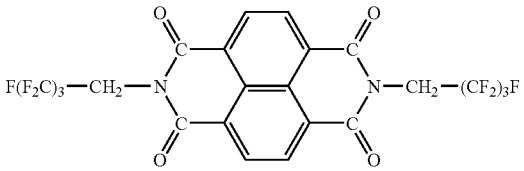

Reduction potential: -0.51 (V)

(E-3)

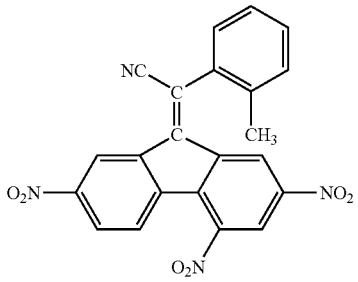

Reduction potential: -0.54 (V)

(E-4)

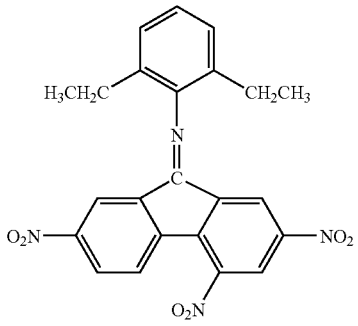

Reduction potential: -0.60 (V)

(E-5)

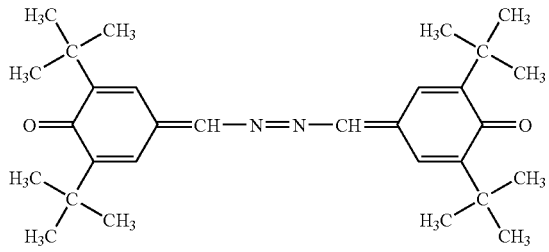

Reduction potential: -0.25 (V)

-continued (E-6)

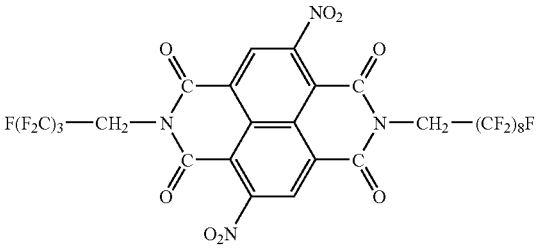

Reduction potential: -0.30 (V)

(E-7)

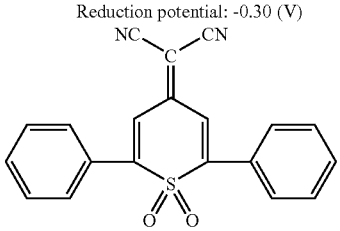

Reduction potential: -0.25 (V)

(E-8)

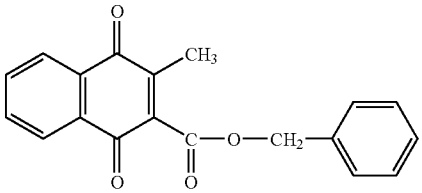

Reduction potential: -0.54 (V)

(E-9)

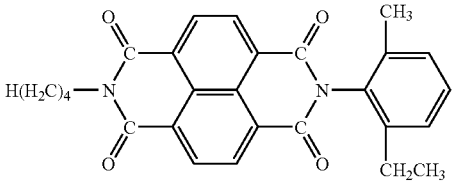

Reduction potential: -0.58 (V)

(E-10)

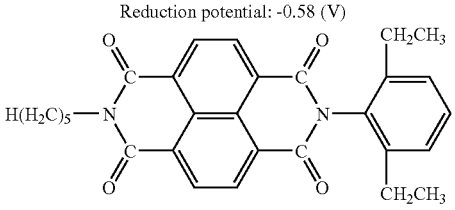

Reduction potential: -0.58 (V)

(E-11)

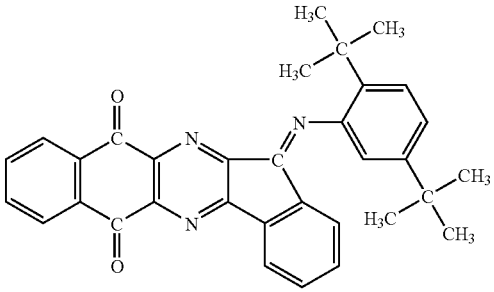

Reduction potential: -0.58 (V)

-continued (E-12)

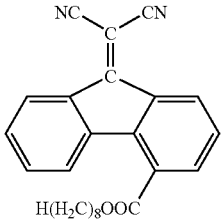

Reduction potential: -0.68 (V)

(E-13)

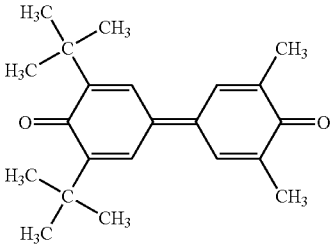

Reduction potential: -0.51 (V)

(E-14)

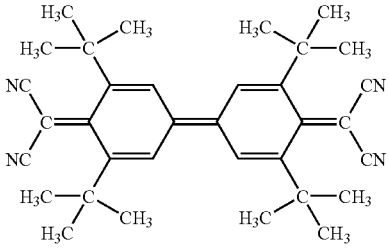

Reduction potential: -0.37 (V)

(E-15)

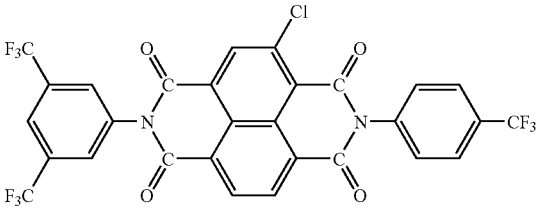

Reduction potential: -0.47 (V)

The electron-transporting material in the charge generation layer may preferably be in a proportion of from 10% to 60% by weight, and more preferably from 21% to 40% by weight, based on the weight of the charge-generating material in the charge generation layer.

Electron affinity ($E_A$) of the electron-transporting material and electron affinity ($G_A$) of the charge-generating material, in the charge generation layer, may preferably be in a difference ($E_A$–$G_A$) of from −0.20 or more to 0.20 or less, more preferably from −0.10 or more to 0.20 or less, and still more preferably more than 0 and 0.20 or less.

In the present invention, the electron affinity is calculated in the following way.

Charge-generating Material

The optical bandgap (1239.8/absorption end (nm)) determined using an ultraviolet visible spectrophotometer V-570, manufactured by JASCO Corporation, is subtracted from the work function determined using an atmospheric pressure electron spectrometer AC-2, manufactured by Riken Keiki Co., Ltd.

Electron-transporting Material

The sum of a numerical value found when the unit of the above reduction potential is "V" and a numerical value (4.53) found when the unit of ionization potential of the saturated calomel electrode is "eV" is the numerical value found when the unit of that electron affinity is "eV".

In addition, the ionization potential of the electrode is statistically calculated in the same manner as disclosed in Japanese Patent Application Laid-open No. 2000-019746, using the charge-transporting material described in the present invention.

The charge generation layer may be formed by coating a charge generation layer coating dispersion obtained by dispersing the charge-generating material and optionally the electron-transporting material in the binder resin together with a solvent, followed by drying. As a method for dispersion, a method is available which makes use of a homogenizer, an ultrasonic dispersion machine, a ball mill, a sand mill, a roll mill, a vibration mill, an attritor or a liquid impact type high-speed dispersion machine. The charge-generating material and the binder resin may preferably be in a proportion ranging from 0.5:1 to 4:1 (weight ratio), and more preferably ranging from 1:1 to 1:3 (weight ratio).

As the solvent used for the charge generation layer coating dispersion, it may be selected from the viewpoint of the binder resin to be used and the solubility or dispersion stability of the charge-generating material. As an organic solvent, usable are alcohols, sulfoxides, ketones, ethers, esters, aliphatic halogenated hydrocarbons, aromatic compounds and so forth.

The charge generation layer may preferably be in a layer thickness of 5 μm or less, and more preferably from 0.01 μm to 2 μm and still more preferably from 0.05 μm to 0.5 μm.

To the charge generation layer, a sensitizer, an antioxidant, an ultraviolet absorber and a plasticizer which may be of various types may also optionally be added.

The hole-transporting material used in the electrophotographic photosensitive member of the present invention may include, e.g., triarylamine compounds, hydrazone compounds, styryl compounds, stilbene compounds, pyrazoline compounds, oxazole compounds, thiazole compounds and triarylmethane compounds. Any of these may be used alone or in a combination of two or more.

As the electron-transporting material to be incorporated in the hole transport layer, preferred is one whose oxidation potential (oxidation potential with respect to a saturated calomel electrode) is in the range of from 0.70 to 0.80 V, and more preferably in the range of from 0.71 to 0.76 V.

In the present invention, the oxidation potential is measured in the same manner as the measurement of the reduction potential, and a peak top of the first oxidation potential as measured is regarded as oxidation potential of the hole-transporting material.

The binder resin used in the hole transport layer may include, e.g., acrylic resins, acrylonitrile resins, allyl resins, alkyd resins, epoxy resins, silicone resins, nylons, phenol resins, phenoxy resins, butyral resins, polyacrylamide resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone resins, polyvinyl butyral resins, polyphenylene oxide resins, polybutadiene resins, polypropylene resins, methacrylic resins, urea resins, vinyl chloride resins and vinyl acetate resins. In particular, polyarylate resins, polycarbonate resins and so forth are preferred. Any of these may be used alone or in the form of a mixture or copolymer of two or more types.

The hole transport layer may be formed by coating a hole transport layer coating solution prepared by dissolving the hole-transporting material and binder resin in a solvent, followed by drying. The hole-transporting material and the binder resin may preferably be in a proportion ranging from 10:5 to 5:10 (weight ratio), and more preferably from 10:8 to 6:10 (weight ratio).

As the solvent used in the hole transport layer coating solution, usable are ketones such as acetone and methyl ethyl ketone, esters such as methyl acetate and ethyl acetate, aromatic hydrocarbons such as toluene and xylene, ethers such as 1,4-dioxane and tetrahydrofuran, and hydrocarbons substituted with a halogen atom, such as chlorobenzene, chloroform and carbon tetrachloride.

The hole transport layer may preferably be in a layer thickness of from 1 μm to 50 μm, and, in particular, more preferably from 3 μm to 30 μm.

To the hole transport layer, an antioxidant, an ultraviolet absorber, a plasticizer and so forth may optionally be added.

A protective layer intended for the protection of the hole transport layer may also be provided on the hole transport layer. The protective layer may be formed by coating a protective layer coating solution obtained by dissolving a binder resins in a solvent, followed by drying. The protective layer may be formed by coating a protective layer coating solution obtained by dissolving a binder resin monomer or oligomer in a solvent, followed by curing and/or drying. To effect the curing, light, heat or radiations (such as electron rays) may be used.

As the binder resin for the protective layer, every king of resin described above may be used.

The protective layer may preferably be in a layer thickness of from 0.5 μm to 10 μm, and more preferably from 1 μm to 5 μm.

When the coating solutions for the above various layers are applied, coating methods may be used as exemplified by dip coating, spray coating, spinner coating, roller coating, Mayer bar coating and blade.

Figure 3:
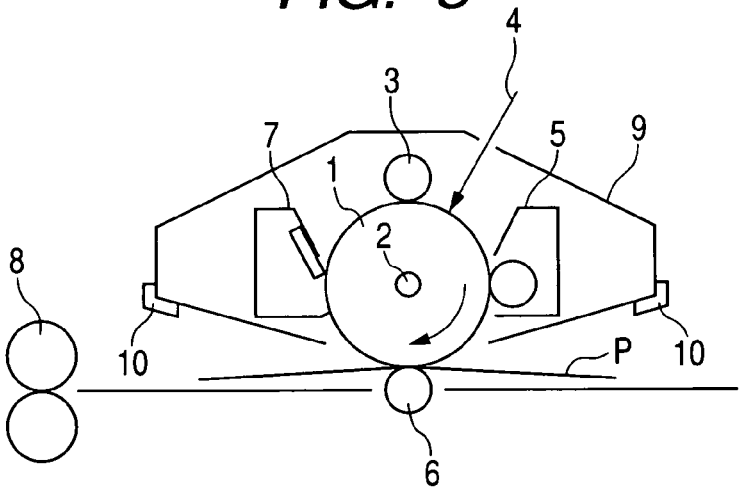
FIG. 3 is a schematic view showing an example of the construction of an electrophotographic apparatus provided with a process cartridge having the electrophotographic photosensitive member of the present invention.

FIG. 3 schematically illustrates an example of the construction of an electrophotographic apparatus provided with a process cartridge having the electrophotographic photosensitive member of the present invention.

In FIG. 3, reference numeral 1 denotes a cylindrical electrophotographic photosensitive member, which is rotatively driven around an axis 2 in the direction of an arrow at a stated peripheral speed.

The surface of the electrophotographic photosensitive member 1 rotatively driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer a developing means 5 has, to form toner images. Then, the toner images thus formed and held on the surface of the electrophotographic photosensitive member 1 are successively transferred by applying a transfer bias from a transfer means (such as a transfer roller) 6, which are transferred onto a transfer material (such as paper) P fed from a transfer material feed means (not shown) to the part (contact zone) between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member 1, is led through a fixing means 8 where the toner images are fixed, and is then put out of the apparatus as an image-formed material (a print or a copy).

The surface of the electrophotographic photosensitive member 1 from which toner images have been transferred is subjected to removal of the developer (toner) remaining after the transfer, through a cleaning means (such as a cleaning blade) 7. Thus, its surface is cleaned. It is further subjected to charge elimination by pre-exposure light (not shown) emitted from a pre-exposure means (not shown), and thereafter repeatedly used for the formation of images. In addition, where, as shown in FIG. 3 the primary charging means 3 is a contact charging means making use of a charging roller or the like, the pre-exposure is not necessarily required.

The apparatus may be constituted of a combination of plural components integrally held in a container as a process cartridge from among the constituents such as the above electrophotographic photosensitive member 1, charging means 3, developing means 5, transfer means 6 and cleaning means 7 so that the process cartridge can be mounted on, and detached from, the main body of an electrophotographic apparatus such as a copying machine or a laser beam printer. In the apparatus shown in FIG. 3, the electrophotographic photosensitive member 1 and the charging means 3, developing means 5 and cleaning means 7 are integrally held to make up a process cartridge 9 that is detachably mountable to the main body of the electrophotographic apparatus through a guide means 10 such as rails provided in the main body of the electrophotographic apparatus.

Figure 4:
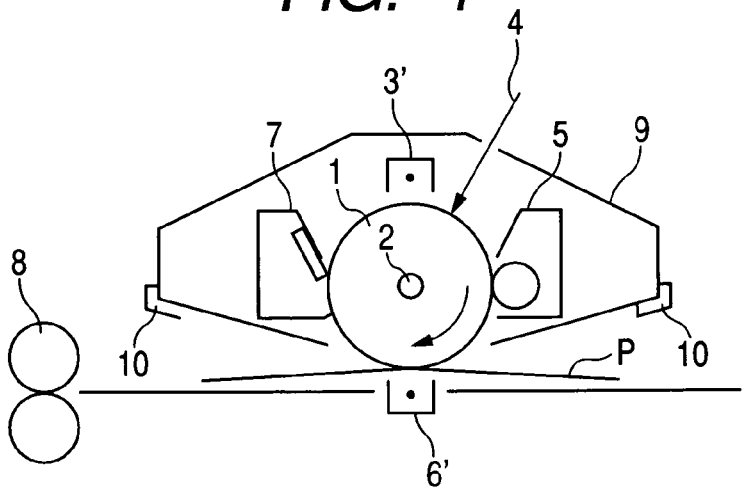
FIG. 4 is a schematic view showing another example of the construction of an electrophotographic apparatus provided with a process cartridge having the electrophotographic photosensitive member of the present invention.

FIG. 4 schematically illustrates another example of the construction of an electrophotographic apparatus provided with a process cartridge having the electrophotographic photosensitive member of the present invention.

The electrophotographic apparatus shown in FIG. 4 has a charging means 3' making use of a corona discharge assembly, and a transfer means 6' making use of a corona discharge assembly. As to how it operates, it does like the electrophotographic apparatus constructed as shown in FIG. 3.

EXAMPLES

The present invention is described below in greater detail by giving specific working examples. The present invention, however, is by no means limited to these. In the following examples, "part(s)" refers to "part(s) by weight".

Electrophotographic

Photosensitive Member 1

An aluminum cylinder of 30 mm in diameter and 260.5 mm in length was prepared as a support.

Next, 10 parts of titanium oxide particles coated with tin oxide containing 10% by weight of antimony oxide, 5 parts of resol type phenol resin (trade name: PRYOPHEN J-325, available from Dainippon Ink & Chemicals, Incorporated), 4 parts of methyl cellosolve, 1 part of methanol and 0.002 part of silicone oil (polydimethylsiloxane-polyoxyalkylene copolymer; weight-average molecular weight: 3,000) were subjected to dispersion for 2 hours by means of a sand mill making use of glass beads of 1 mm in diameter, to prepare a conductive layer coating dispersion.

This conductive layer coating dispersion was applied onto the support by dipping, followed by drying at 150° C. for 30 minutes to form a conductive layer with a layer thickness of 15 μm.

Next, 15 parts of alcohol-soluble polyamide resin (trade name: AMILAN CM8000, available from Toray Industries, Inc.) was dissolved in a mixed solvent of 150 parts of methanol and 200 parts of butanol to prepare an intermediate layer coating solution.

This intermediate layer coating solution was applied onto the conductive layer by dipping, followed by drying at 90° C. for 10 minutes to form an intermediate layer with a layer thickness of 0.7 μm.

Next, 2 parts of hydroxygallium phthalocyanine crystals with a crystal form having strong peaks at Bragg angles 2θ±0.2° of 7.3°, 24.9° and 28.1° in CuKα characteristic X-ray diffraction (a charge-generating material), 1 part of polyvinyl butyral resin (trade name: S-LEC BM-S, available from Sekisui Chemical Co., Ltd.), 25 parts of tetrahydrofuran and 5 parts of cyclohexanone were subjected to dispersion for 5 hours by means of a sand mill making use of glass beads of 1 mm in diameter, and then 150 parts of tetrahydrofuran and 50 parts of cyclohexanone were added. To the mixture obtained, 0.6 part of a compound having structure represented by the above formula (E-1) (an electron-transporting material) was dissolved to prepare a charge generation layer coating dispersion. (The charge-generating material had an average particle diameter of 0.18 μm, which was measured by centrifugal sedimentation using CAPA700, manufactured by Horiba, Ltd.) This charge generation layer coating dispersion was applied onto the intermediate layer by dipping, followed by drying at 100° C. for 10 minutes to form a charge generation layer with a layer thickness of 0.2 μm.

Next, 5 parts of a compound represented by the following formula (2) (a hole-transporting material; oxidation potential: 0.71 (V); mobility: $1.5\times10^{-6}$ ($cm^2/(V\cdot s)$))

(2)

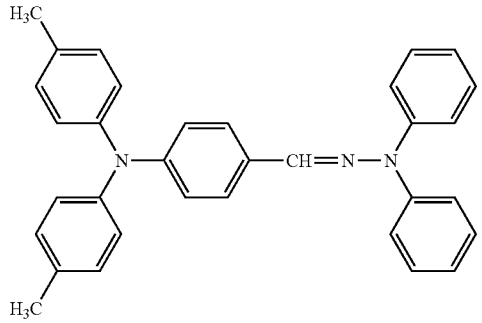

and 6 parts of polyarylate resin having a repeating structural unit represented by the following formula (3) (weight-average molecular weight: 100,000, which was measured with a gel permeation chromatograph HLC-8120, manufactured by Tosoh Corporation, and was a value calculated in terms of polystyrene; using a 0.1% by weight tetrahydrofuran solution as a developing solvent, using TSKgel Super HM-N, available from Tosoh Corporation as columns, using RI as a detector, setting column temperature at 40° C., setting injection quantity to 20 μl, and setting flow rate at 1.0 ml/min; weight ratio of terephthalic acid skeleton to isophthalic acid skeleton in the repeating structural unit: 50:50):

(3)

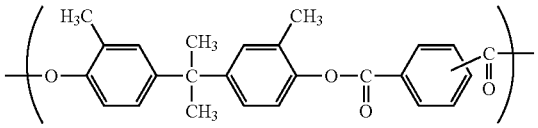

were dissolved in a mixed solvent of 35 parts of monochlorobenzene and 10 parts of tetrahydrofuran to prepare a hole transport layer coating solution (a charge transport layer coating solution; the same applies hereafter).

This hole transport layer coating solution was applied onto the charge generation layer by dipping, followed by drying at 110° C. for 70 minutes to form a hole transport layer (a charge transport layer; the same applies hereinafter) with a layer thickness of 20 μm.

Thus, an electrophotographic photosensitive member was produced having a support and a conductive layer, an intermediate layer, a charge generation layer and a hole transport layer in this order on the support wherein the hole transport layer is a surface layer.

The m and m' of the electrophotographic photosensitive member produced were measured in such a manner as described previously. The values of m and m' are shown in Table 2.

Electrophotographic

Photosensitive Members 2 to 17

Electrophotographic photosensitive members were produced in the same manner as in Electrophotographic Photosensitive Member 1 except that the type and amount of the charge-generating material, the type and amount of the charge-transporting material and the type and amount of the binder resin in the charge generation layer coating dispersion, and the type of the hole-transporting material in the charge transport layer coating solution were changed as shown in Table 1. The m and m' were measured in the same way. The values of the m and m' are shown in Table 2.

Electrophotographic

Photosensitive Members 18 to 21

Electrophotographic photosensitive members were produced in the same manner as in Electrophotographic Photosensitive Member 1 except that the intermediate layer was provided directly on the support without providing any conductive layer and instead the surface of the support was subjected to wet honing to be roughened, and the type and amount of the charge-generating material, the type and amount of the charge-transporting material and the type and amount of the binder resin in the charge generation layer coating dispersion, and the type of the hole-transporting material in the charge transport layer coating solution were changed as shown in Table 1. The m and m' were measured in the same way. The values of the m and m' are shown in Table 2.

Electrophotographic

Photosensitive Members 22 to 25

Electrophotographic photosensitive members were produced in the same manner as in Electrophotographic Photosensitive Member 1 except that the type and amount of the charge-generating material, the type and amount of the charge-transporting material and the type and amount of the binder resin in the charge generation layer coating dispersion, and the type of the hole-transporting material in the charge transport layer coating solution were changed as shown in Table 1. The m and m' were measured in the same way. The values of the m and m' are shown in Table 2.

TABLE 1

| | Charge generation layer | | | | | | | Hole transport layer | | |
|---|---|---|---|---|---|---|---|---|---|---|
| | Charge-generating material | | Electron-transporting material | | | | | Hole-transporting material | | |
| | Electron | | Reduction | | Binder resin | | | Oxidation | | |
| (1) | affinity (eV) | Amt. (pbw) | | potential (V) | Amt. (pbw) | | Amt. (pbw) | | potential (V) | Mobility ($\times 10^{-6}$cm$^2$/V · s) |
| 1 HOGaPc | 4.05 | 2 | (E-1) | −0.47 | 0.6 | BM-S | 1 | (2) | 0.71 | 1.5 |
| 2 TiOPc | 4.02 | 2 | (E-2) | −0.51 | 0.6 | BM-S | 1 | (2) | 0.71 | 1.5 |
| 3 HOGaPc | 4.05 | 2 | (E-2) | −0.51 | 0.6 | BX-1 | 1 | (6) | 0.82 | 0.74 |
| 4 TiOPc | 4.02 | 2 | (E-1) | −0.47 | 0.6 | BX-1 | 1 | (6) | 0.82 | 0.74 |
| 5 HOGaPc | 4.05 | 3 | (E-3) | −0.54 | 0.9 | BX-1 | 1 | (6) | 0.82 | 0.74 |
| 6 TiOPc | 4.02 | 2 | (E-2) | −0.51 | 0.6 | BX-1 | 1 | (7) | 0.91 | 1.0 |
| 7 (4) | 4.41 | 2 | (E-4) | −0.60 | 1 | BM-S | 1 | (7) | 0.91 | 1.0 |
| 8 HOGaPc | 4.05 | 1 | (E-5) | −0.25 | 0.21 | BX-S | 1 | (7) | 0.91 | 1.0 |
| 9 HOGaPc | 4.05 | 2 | (E-6) | −0.30 | 0.7 | BX-S | 1 | (8) | 0.81 | 3.1 |
| 10 TiOPc | 4.02 | 2 | (E-7) | −0.25 | 0.5 | BX-S | 1 | (8) | 0.81 | 3.1 |
| 11 HOGaPc | 4.05 | 2 | (E-8) | −0.54 | 0.6 | BM-S | 1 | (8) | 0.81 | 3.1 |
| 12 (5) | 4.08 | 1 | (E-9) | −0.58 | 0.6 | BX-S | 1 | (9) | 0.76 | 6.9 |
| 13 HOGaPc | 4.05 | 2 | (E-10) | −0.58 | 0.6 | BX-S | 1 | (9) | 0.76 | 6.9 |
| 14 HOGaPc | 4.05 | 2 | (E-2) | −0.61 | 0.6 | BX-S | 1 | (9) | 0.76 | 6.9 |
| 15 HOGaPc | 4.05 | 2 | (E-3) | −0.54 | 0.6 | BM-S | 1 | (10) | 0.76 | 6.8 |
| 16 (5) | 4.08 | 2 | (E-11) | −0.58 | 0.6 | BX-S | 1 | (10) | 0.76 | 6.8 |
| 17 TiOPc | 4.02 | 2 | (E-15) | −0.47 | 0.6 | BX-S | 1 | (10) | 0.76 | 6.8 |
| 18 TiOPc | 4.02 | 2 | (E-5) | −0.25 | 1 | BX-S | 1 | (11) | 0.81 | 5.2 |
| 19 HOGaPc | 4.05 | 2 | (E-7) | −0.25 | 1 | BM-S | 1 | (11) | 0.81 | 5.2 |
| 20 HOGaPc | 4.05 | 2 | (E-1) | −0.47 | 0.6 | BX-S | 1 | (11) | 0.81 | 5.2 |
| 21 HOGaPc | 4.05 | 2 | (E-3) | −0.54 | 0.6 | U-100 | 0.6 | (11) | 0.81 | 5.2 |
| 22 TiOPc | 4.02 | 2 | | Not used. | | BL-1 | 1 | (12) | 0.50 | 1.1 |
| 23 TiOPc | 4.02 | 1 | | Not used. | | BL-1 | 1.5 | (12) | 0.50 | 1.1 |

TABLE 1-continued

| | Charge generation layer | | | | | | | | Hole transport layer | | |
|---|---|---|---|---|---|---|---|---|---|---|---|
| | Charge-generating material | | Electron-transporting material | | | | | | Hole-transporting material | | |
| | Electron | | Reduction | | | Binder resin | | | Oxidation | | |
| (1) | affinity (eV) | Amt. (pbw) | | potential (V) | Amt. (pbw) | | Amt. (pbw) | | potential (V) | Mobility ($\times 10^{-6}$cm$^2$/V · s) |
| 24 (4) | 4.41 | 2 | (E-12) | −0.68 | 0.6 | BL-1 | 1 | (12) | 0.50 | 1.1 |
| 25 TiOPc | 4.02 | 2 | (E-13) | −0.61 | 0.02 | BL-1 | 1 | (12) | 0.50 | 1.1 |

(1): Electrophotographic Photosensitive Member
Amt: Amount
pbw: part by weight

In Table 1, "HOGaPc" stands for hydroxygallium phthalocyanine crystals with a crystal form having strong peaks at Bragg angles 2θ±0.2° of 7.3°, 24.9° and 28.1° in CuKα characteristic X-ray diffraction; "TiOPc" stands for oxytitanium phthalocyanine crystals with a crystal form having strong peaks at Bragg angles 2θ±0.2° of 9.5°, 9.7°, 11.7°, 15.0°, 23.5°, 24.1° and 27.3° in CuKα characteristic X-ray diffraction; "(4)" stands for an azo pigment having structure represented by the following formula (4); "(5)" stands for an azo pigment having structure represented by the following formula (5); "BM-S" stands for polyvinyl butyral resin (trade name: S-LEC BM-S, available from Sekisui Chemical Co., Ltd.); "BX-1" stands for polyvinyl butyral resin (trade name: S-LEC BX-1, available from Sekisui Chemical Co., Ltd.); "U-100" stands for polyarylate resin (trade name: U-100, available from Unichika, Ltd.); "(2)" stands for a compound having structure represented by the above formula (2); "(6)" stands for a compound having structure represented by the following formula (6); "(7)" stands for a compound having structure represented by the following formula (7); "(8)" stands for a compound having structure represented by the following formula (8); "(9)" stands for a compound having structure represented by the following formula (9); "(10)" stands for a compound having structure represented by the following formula (10); "(11)" stands for a compound having structure represented by the following formula (11); and "(12)" stands for a compound having structure represented by the following formula (12).

(4)

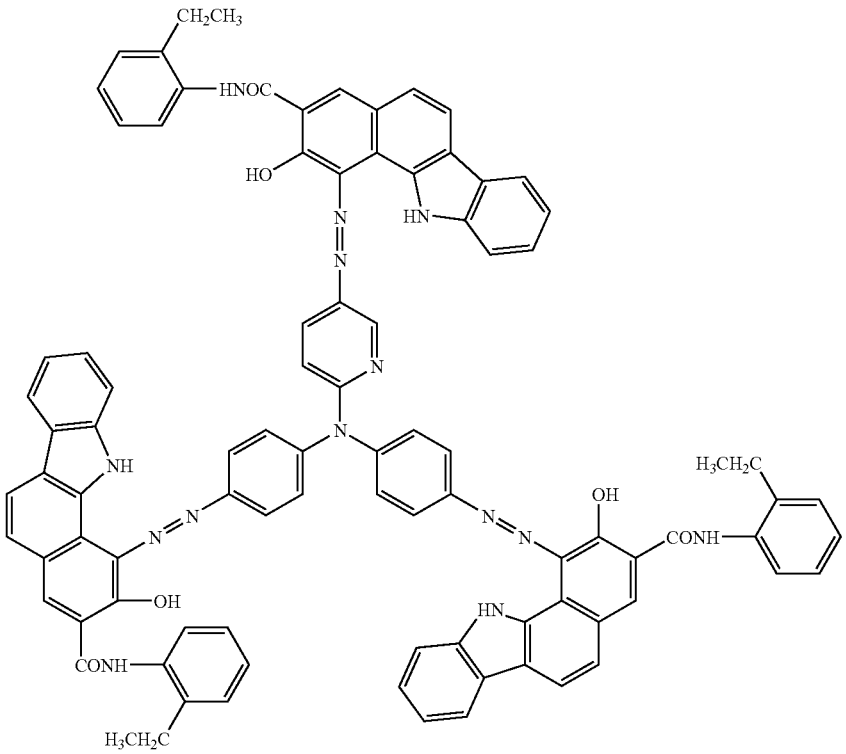

-continued
(5)
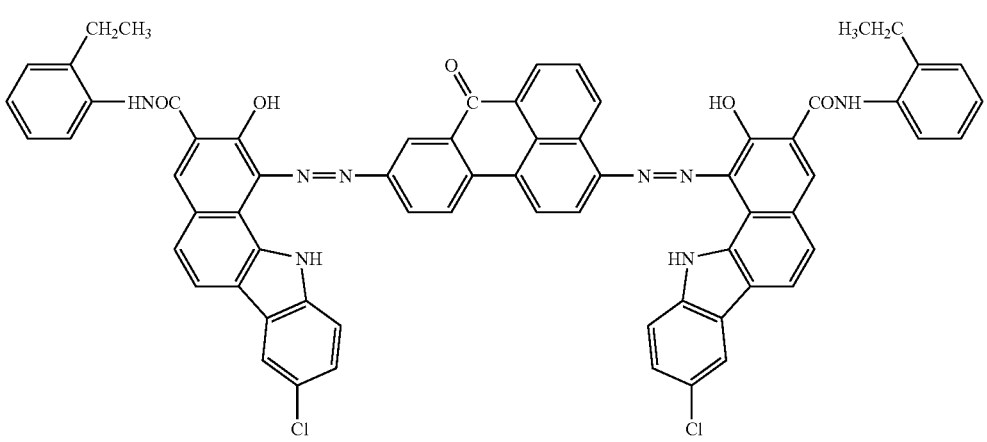
(7)
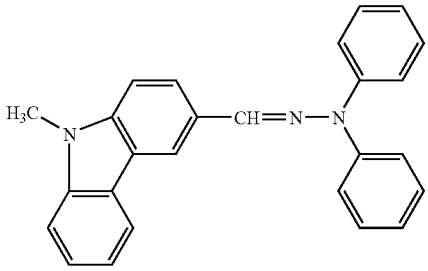
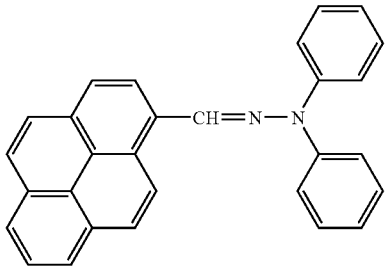
(9)
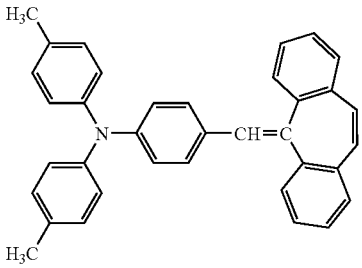
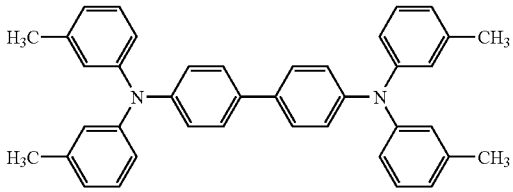
(11)
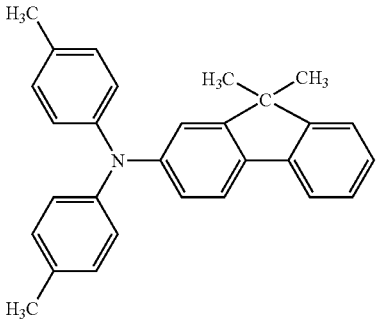
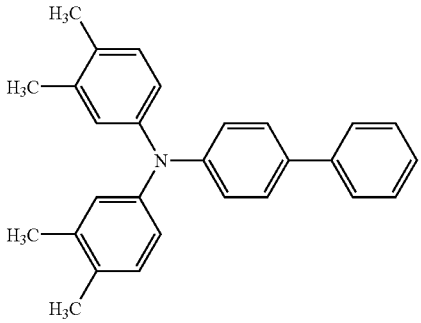

-continued (12)

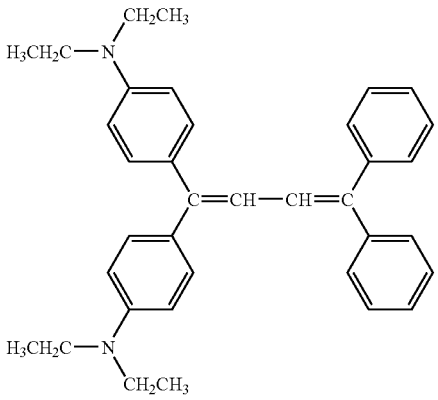

Electrophotographic

Photosensitive Member 26

An electrophotographic photosensitive member was produced in the same manner as in Electrophotographic Photosensitive Member 22 except that 2 parts of the oxytitanium phthalocyanine crystals with a crystal form having strong peaks at Bragg angles 2θ±0.2° of 9.5°, 9.7°, 11.7°, 15.0°, 23.5°, 24.1° and 27.3° in CuKα characteristic X-ray diffraction was changed to 2 parts of a hydroxygallium phthalocyanine crystal synthesized as described below. The m and m' were measured in the same way. The values of the m and m' are shown in Table 2.

That is, 73 g of o-phthalodinitrile, 25 g of gallium trichloride and 400 ml of α-chloronaphthalene were allowed to react at 200° C. for 4 hours in an atmosphere of nitrogen, and thereafter the product obtained was filtered at 130° C. The product having been filtered was subjected to dispersion washing at 130° C. for 1 hour using N,N-dimethylformamide, and then filtered and washed with methanol, followed by drying to obtain 45 g of chlorogallium phthalocyanine.

15 g of this chlorogallium phthalocyanine was dissolved in 450 g of 10° C. concentrated sulfuric acid, and the solution obtained was dropwise added to 2,300 g of ice water with stirring to effect reprecipitation, followed by filtration. Next, the product having been filtered was subjected to dispersion washing with 2% ammonia water, and thereafter thoroughly washed with ion-exchange water, and then filtered, followed by drying to obtain 13 g of hydroxygallium phthalocyanine.

10 g of this hydroxygallium phthalocyanine, 300 g of N,N'-dimethylformamide and 0.4 g of a compound having structure represented by the above formula (E-14) (an electron-transporting material) were subjected to milling at 22° C. for 6 hours together with 450 g of glass beads of 1 mm in diameter. After the milling, solid matter was taken out from the liquid, and was washed with methanol and then thoroughly with water, followed by drying to obtain 9.2 g of hydroxygallium phthalocyanine.

Electrophotographic

Photosensitive Member 27

An electrophotographic photosensitive member was produced in the following way with reference to description relating to the production of the electrophotographic photosensitive member of Example 16 in Japanese Patent Application Laid-open No. H09-096914. The m and m' were measured in the same way. The values of the m and m' are shown in Table 2.

An aluminum cylinder of 30 mm in diameter and 260.5 mm in length was prepared as a support. In addition, the surface of the support was roughened by wet honing in the same manner as Electrophotographic Photosensitive Member 18.

Next, 4 parts of dichlorotin phthalocyanine crystals with a crystal form having strong peaks at Bragg angles 2θ±0.2° of 8.3°, 13.7° and 28.3° in CuKα characteristic X-ray diffraction (a charge-generating material), 2 parts of polyvinyl butyral resin (trade name: S-LEC BM-S, available from Sekisui Chemical Co., Ltd.) and 100 parts of n-butanol were subjected to dispersion for 2 hours by paint shaking making use of glass beads, to prepare a charge generation layer coating dispersion.

This charge generation layer coating dispersion was applied onto the support by dipping, followed by drying at 115° C. for 10 minutes to form a charge generation layer with a layer thickness of 0.5 μm.

Next, 15 parts of fine hexagonal selenium crystals, 8 parts of vinyl chloride-vinyl acetate copolymer (trade name: UCAR Solution Vinyl Resin VMCH, available from Union Carbide; electrical resistivity: $10^{14}$ Ω·cm) and 100 parts of isobutyl acetate were subjected to dispersion for 200 hours by means of an attritor making use of stainless steel beads of 3 mm in diameter, to prepare a sigmoid (S-shaped) type charge transport layer coating dispersion.

This sigmoid type charge transport layer coating solution was applied onto the charge generation layer by dipping, followed by drying at 115° C. for 10 minutes to form a sigmoid type charge transport layer (a first hole transport layer) with a layer thickness of 2 μm.

In addition, the hexagonal selenium in the sigmoid type charge transport layer was in a volume ratio of about 35%. Also, the hexagonal selenium had an average particle diameter of 0.05 μm.

Next, 15 parts of a compound having a repeating structural unit represented by the following formula (13) (molecular weight: 80,000, a high-molecular weight hole-transporting material):

(13)

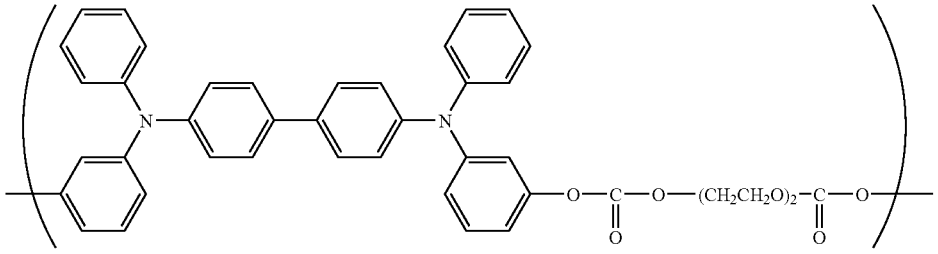

was dissolved in 85 parts of monochlorobenzene to prepare a hole transport layer coating solution (a second hole transport layer coating solution).

This hole transport layer coating solution (second hole transport layer coating solution) was applied onto the sigmoid type charge transport layer (first hole transport layer) by dipping, followed by drying at 135° C. for 1 hour to form a hole transport layer (a second hole transport layer) with a layer thickness of 20 μm.

Thus, an electrophotographic photosensitive member was produced having a support, and a charge generation layer, a sigmoid type charge transport layer (first hole transport layer) and a hole transport layer (second hole transport layer) in this order on the support; the hole transport layer (second hole transport layer) being a surface layer.

TABLE 2

| Electro-photographic Photosensitive Member | m | m' | \|m − m'\| |
|---|---|---|---|
| 1 | 0.003 | 0.000 | 0.003 |
| 2 | 0.004 | 0.000 | 0.004 |
| 3 | 0.005 | 0.000 | 0.005 |
| 4 | 0.005 | 0.000 | 0.005 |
| 5 | 0.008 | 0.000 | 0.008 |
| 6 | 0.008 | 0.000 | 0.008 |
| 7 | 0.020 | 0.000 | 0.020 |
| 8 | 0.015 | 0.000 | 0.015 |
| 9 | 0.005 | 0.000 | 0.005 |
| 10 | 0.018 | 0.001 | 0.017 |
| 11 | 0.008 | 0.000 | 0.008 |
| 12 | 0.010 | 0.000 | 0.010 |
| 13 | 0.011 | 0.000 | 0.011 |
| 14 | 0.006 | 0.000 | 0.006 |
| 15 | 0.010 | 0.000 | 0.010 |
| 16 | 0.012 | 0.000 | 0.012 |
| 17 | 0.006 | 0.000 | 0.006 |
| 18 | 0.018 | 0.001 | 0.017 |
| 19 | 0.016 | 0.000 | 0.016 |
| 20 | 0.006 | 0.000 | 0.006 |
| 21 | 0.001 | 0.000 | 0.001 |
| 22 | 0.023 | 0.001 | 0.022 |
| 23 | 0.030 | 0.000 | 0.030 |
| 24 | 0.028 | 0.000 | 0.028 |
| 25 | 0.027 | 0.002 | 0.025 |
| 26 | 0.031 | 0.003 | 0.028 |
| 27 | 0.147 | 0.005 | 0.142 |

In addition, for the following Evaluations 1 to 3, three members were prepared for each of Electrophotographic Photosensitive Members 1 to 27.

Evaluation 1 of Electrophotographic Photosensitive Members

Examples 1 to 21 & Comparative Examples 1 to 6

Electrophotographic photosensitive members used in Examples 1 to 21 and Comparative Examples 1 to 6 are as shown in Table 3.

An evaluation apparatus used in Evaluation 1 is a modified machine of a laser beam printer operated by contact charging making use of a charging roller, reverse development and negative charging (trade name: LBP2510, manufactured by CANON INC.). This evaluation apparatus is one modified so that the amount of exposure light is variable and the resolution is 1,200 dpi (laser spot diameter: 80 μm). A voltage generated by superimposing a sinusoidal AC voltage of 1,800 V in peak-to-peak voltage and 800 Hz in frequency on a DC voltage of −650 V is applied to the charging roller by means of a high-pressure power source Model 610, manufactured by TREK Inc.

The electrophotographic photosensitive member produced in each example was attached to a cyan color process cartridge of LBP2510, and this process cartridge was set in the evaluation apparatus. Setting dark-area potential at −650V and light-area potential at 2050V, images were reproduced in a 25° C. and 15% RH environment and evaluated.

First, images with a density of 12% were reproduced on 5,000 sheets, and thereafter the dark-area potential and the light-area potential were measured without changing the setting of the amount of light. The potential was measured by attaching a potential probe (trade name: Model 6000B-8, manufactured by TREK Inc.) to the development position, and using a surface potentiometer (trade name: Model 1344, manufactured by TREK Inc.). Evaluation was made on the difference between dark-area potential before 5,000-sheet reproduction ($Vd_0$=−650 V) and dark-area potential after 5,000-sheet reproduction ($Vd_{5000}$), and the difference between light-area potential before 5,000-sheet reproduction ($Vl_0$=−200 V) and light-area potential after 5,000-sheet reproduction ($Vl_{5000}$).

Figure 5:
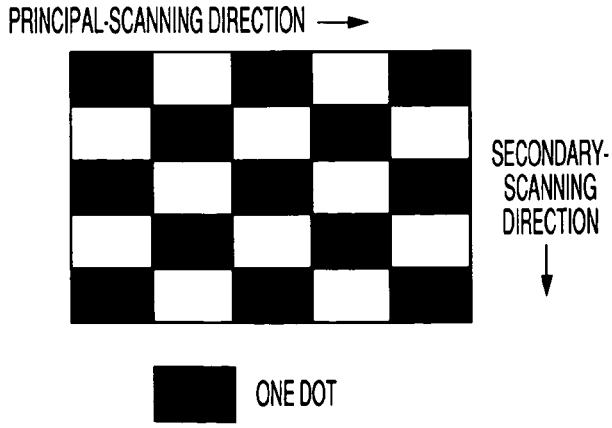
FIG. 5 shows a one-dot and one-space image used in Examples and Comparative Example.

Thereafter, the dark-area potential and the light-area potential were adjusted again so as to be −650 V and −200 V, respectively, where a one-dot and one-space image (see FIG. 5) and a 5-point character image were reproduced for image evaluation. The evaluation results are shown in Table 3.

The one-dot and one-space images reproduced were evaluated in the following way.

Figure 6:
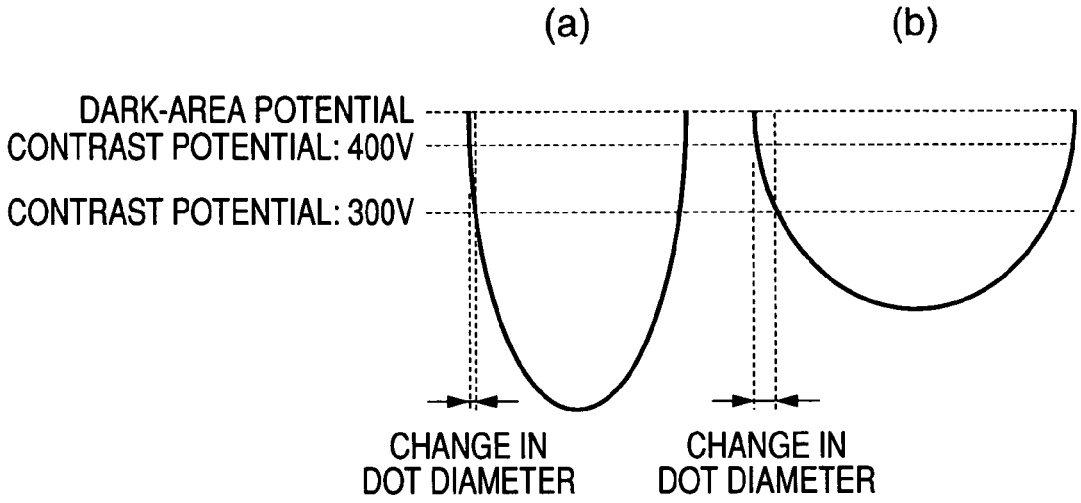
FIG. 6 illustrates changes in dot diameter that are incidental to changes in contrast potential.

Development bias was changed, and contrast potential (the absolute value of the difference between development bias and light-area potential) was set at from 300 V to 400 V, where evaluation was made on changes in dot diameters. The shallower and broader the dots of electrostatic latent images are, the larger the changes in dot diameters are. (See FIG. 6. In FIG. 6, letter symbol (a) shows a case in which a dot is relatively deep and narrow, and letter symbol (b) shows a case in which a dot is relatively shallow and broad.) In the evaluation, a dot analyzer DA-5000S, manufactured by Oji Scientific Instruments, was used. Before toner images on the surface of the electrophotographic photosensitive member were all transferred to paper, the electrophotographic photosensitive member was operated to stop being rotated, and was left standing for 18 hours. Thereafter, the process cartridge was taken out, and dot diameters at the middle area in the lengthwise direction of the electrophotographic photosensitive member were measured on 20 dots to find a difference in their average values.

As to the 5-point character images reproduced, evaluation was made on relative values found when the line widths of the characters in Example 1 were assumed as 1.00 and on the state of the characters visually inspected as they were.

TABLE 3

| | | Evaluation on potential variations | | Reproduced-image evaluation | | |
|---|---|---|---|---|---|---|
| | | | | Change in dot diameter (μm) | Character images Line width relative value | Visual inspection |
| | (1) | $Vd_{5000}-Vd_0$ (V) | $Vl_{5000}-Vl_0$ (V) | | | |
| Example: | | | | | | |
| 1 | 1 | −15 | −5 | 13.6 | 1.00 | Good. |
| 2 | 2 | −15 | −5 | 14.7 | 1.04 | Good. |
| 3 | 3 | −15 | −5 | 15.3 | 1.05 | Good. |
| 4 | 4 | −15 | −5 | 13.9 | 1.02 | Good. |
| 5 | 5 | −15 | −20 | 15.0 | 1.04 | Good. |
| 6 | 6 | −15 | −5 | 16.4 | 1.09 | Good. |
| 7 | 7 | −30 | −20 | 17.9 | 1.14 | Good. |
| 8 | 8 | −25 | −40 | 17.0 | 1.10 | Good. |
| 9 | 9 | −20 | −25 | 14.3 | 1.02 | Good. |
| 10 | 10 | −30 | −35 | 18.0 | 1.14 | Good. |
| 11 | 11 | −20 | −25 | 15.9 | 1.07 | Good. |
| 12 | 12 | −25 | −35 | 15.7 | 1.07 | Good. |
| 13 | 13 | −20 | −20 | 16.0 | 1.09 | Good. |
| 14 | 14 | −15 | −10 | 14.8 | 1.04 | Good. |
| 15 | 15 | −20 | −25 | 15.7 | 1.07 | Good. |
| 16 | 16 | −20 | −30 | 15.7 | 1.07 | Good. |
| 17 | 17 | −15 | −10 | 14.0 | 1.02 | Good. |
| 18 | 18 | −30 | −40 | 18.0 | 1.14 | Good. |
| 19 | 19 | −30 | −40 | 17.7 | 1.13 | Good. |
| 20 | 20 | −15 | −10 | 13.9 | 1.01 | Good. |
| 21 | 21 | −25 | −20 | 16.0 | 1.08 | Good. |
| Comparative Example: | | | | | | |
| 1 | 22 | −20 | −40 | 19.6 | 1.19 | Almost good.* |
| 2 | 23 | −20 | −55 | 19.9 | 1.20 | Almost good.* |
| 3 | 24 | −25 | −45 | 19.1 | 1.18 | Almost good.* |
| 4 | 25 | −30 | −40 | 19.2 | 1.19 | Almost good.* |
| 5 | 26 | −25 | −45 | 19.5 | 1.19 | Almost good.* |
| 6 | 27 | −120 | +75 | — | — | Crushed. |

(1): Electrophotographic Photosensitive Member
*(blur around characters)

Evaluation 2 of Electrophotographic Photosensitive Members

Examples 22 to 42 & Comparative Examples 7 to 12

Electrophotographic photosensitive members used in Examples 22 to 42 and Comparative Examples 7 to 12 are as shown in Table 4.

An evaluation apparatus used in Evaluation 2 is the same as the evaluation apparatus used in Evaluation 1 except that the voltage to be applied to the charging roller was changed to only a DC voltage (the voltage was adjusted to a value with which the surface potential of the electrophotographic photosensitive member is set to be −650 V).

The evaluation was made in the same way as in Evaluation 1. The results of evaluation are shown in Table 4.

TABLE 4

| | | Evaluation on potential variations | | Reproduced-image evaluation | | |
|---|---|---|---|---|---|---|
| | | | | Change in dot | Character images Line width | |
| | (1) | $Vd_{5000}-Vd_0$ (V) | $Vl_{5000}-Vl_0$ (V) | diameter (μm) | relative value | Visual observation |
| Example: | | | | | | |
| 22 | 1 | −15 | −5 | 13.8 | 1.01 | Good. |
| 23 | 2 | −15 | −5 | 14.9 | 1.04 | Good. |
| 24 | 3 | −20 | −5 | 15.3 | 1.05 | Good. |
| 25 | 4 | −15 | −5 | 14.0 | 1.02 | Good. |
| 26 | 5 | −20 | −20 | 15.1 | 1.05 | Good. |
| 27 | 6 | −15 | −5 | 16.5 | 1.09 | Good. |
| 28 | 7 | −30 | −20 | 18.0 | 1.14 | Good. |
| 29 | 8 | −25 | −35 | 17.0 | 1.11 | Good. |
| 30 | 9 | −20 | −25 | 14.2 | 1.03 | Good. |
| 31 | 10 | −30 | −40 | 18.0 | 1.14 | Good. |
| 32 | 11 | −20 | −25 | 16.0 | 1.08 | Good. |
| 33 | 12 | −25 | −30 | 15.9 | 1.07 | Good. |
| 34 | 13 | −20 | −20 | 16.2 | 1.08 | Good. |
| 35 | 14 | −15 | −10 | 14.8 | 1.04 | Good. |
| 36 | 15 | −20 | −25 | 15.7 | 1.07 | Good. |
| 37 | 16 | −25 | −35 | 15.8 | 1.08 | Good. |
| 38 | 17 | −15 | −10 | 14.1 | 1.02 | Good. |
| 39 | 18 | −30 | −40 | 18.4 | 1.15 | Good. |
| 40 | 19 | −30 | −40 | 17.9 | 1.14 | Good. |
| 41 | 20 | −15 | −10 | 14.0 | 1.02 | Good. |
| 42 | 21 | −25 | −20 | 16.2 | 1.08 | Good. |
| Comparative Example: | | | | | | |
| 7 | 22 | −20 | −40 | 19.6 | 1.19 | Almost good.* |
| 8 | 23 | −20 | −55 | 19.8 | 1.20 | Almost good.* |
| 9 | 24 | −20 | −50 | 19.3 | 1.18 | Almost good.* |
| 10 | 25 | −30 | −40 | 19.3 | 1.18 | Almost good.* |
| 11 | 26 | −25 | −45 | 19.6 | 1.19 | Almost good.* |
| 12 | 27 | −130 | +75 | — | — | Crushed. |

(1): Electrophotographic Photosensitive Member
*(blur around characters)

Evaluation 3 of Electrophotographic Photosensitive Members

Examples 43 to 63 & Comparative Examples 13 to 18

Electrophotographic photosensitive members used in Examples 43 to 63 and Comparative Examples 13 to 18 are as shown in Table 5.

An evaluation apparatus used in Evaluation 3 is the same as the evaluation apparatus used in Evaluation 1 except that the charging was changed to corona charging (the value of voltage to be applied to a corona charging assembly was adjusted to a value with which the surface potential of the electrophotographic photosensitive member is set to be −650 V).

The evaluation was made in the same way as in Evaluation 1. The results of evaluation are shown in Table 5.

TABLE 5

| | | Evaluation on potential variations | | Reproduced-image evaluation | | |
|---|---|---|---|---|---|---|
| | | | | Change in dot | Character images Line width | |
| | (1) | $Vd_{5000}-Vd_0$ (V) | $Vl_{5000}-Vl_0$ (V) | diameter (μm) | relative value | Visual observation |
| Example: | | | | | | |
| 43 | 1 | −20 | −5 | 14.6 | 1.03 | Good. |
| 44 | 2 | −15 | −5 | 15.6 | 1.07 | Good. |
| 45 | 3 | −20 | −5 | 16.0 | 1.08 | Good. |
| 46 | 4 | −15 | −5 | 14.8 | 1.04 | Good. |
| 47 | 5 | −20 | −20 | 16.2 | 1.08 | Good. |

TABLE 5-continued

| | | Evaluation on potential variations | | Reproduced-image evaluation | | |
|---|---|---|---|---|---|---|
| | | | | | Character images | |
| | (1) | $Vd_{5000}-Vd_0$ (V) | $Vl_{5000}-Vl_0$ (V) | Change in dot diameter (μm) | Line width relative value | Visual observation |
| 48 | 6 | −15 | −10 | 17.2 | 1.12 | Good. |
| 49 | 7 | −30 | −20 | 18.6 | 1.16 | Good. |
| 50 | 8 | −30 | −40 | 17.6 | 1.13 | Good. |
| 51 | 9 | −20 | −30 | 15.4 | 1.06 | Good. |
| 52 | 10 | −30 | −40 | 18.5 | 1.16 | Good. |
| 53 | 11 | −20 | −25 | 16.8 | 1.11 | Good. |
| 54 | 12 | −25 | −35 | 16.7 | 1.10 | Good. |
| 55 | 13 | −20 | −20 | 17.2 | 1.12 | Good. |
| 56 | 14 | −20 | −10 | 15.7 | 1.07 | Good. |
| 57 | 15 | −20 | −30 | 16.8 | 1.10 | Good. |
| 58 | 16 | −25 | −35 | 16.8 | 1.10 | Good. |
| 59 | 17 | −20 | −10 | 14.9 | 1.04 | Good. |
| 60 | 18 | −30 | −40 | 19.1 | 1.17 | Good. |
| 61 | 19 | −30 | −45 | 18.6 | 1.16 | Good. |
| 62 | 20 | −20 | −10 | 15.0 | 1.04 | Good. |
| 63 | 21 | −25 | −10 | 17.2 | 1.11 | Good. |
| Comparative Example: | | | | | | |
| 13 | 22 | −20 | −40 | 22.2 | 1.28 | Somewhat thick line. |
| 14 | 23 | −20 | −60 | 23.2 | 1.32 | Somewhat thick line. |
| 15 | 24 | −25 | −50 | 23.0 | 1.30 | Somewhat thick line. |
| 16 | 25 | −30 | −45 | 22.3 | 1.28 | Somewhat thick line. |
| 17 | 26 | −25 | −45 | 23.0 | 1.31 | Somewhat thick line. |
| 18 | 27 | −150 | +65 | — | — | Crushed. |

(1): Electrophotographic Photosensitive Member

In addition, in Comparative Examples 6, 12 and 18, the one-dot and one-space images were attempted to be reproduced, but resulted in solid black images, and hence the dot diameters were not measurable.

This application claims priority from Japanese Patent Application No. 2003-434016 filed Dec. 26, 2003, which is hereby incorporated by reference herein.

What is claimed is:

1. An electrophotographic photosensitive member comprising:

(a) a support, (b) a charge generation layer containing a charge-generating material and an electron-transporting material, provided on the support, and (c) a charge transport layer containing a hole-transporting material, provided on the charge generation layer, wherein:

where in a light attenuation curve drawn in a way in which the surface of the electrophotographic photosensitive member is so charged that intensity of an electric field applied to the electrophotographic photosensitive member is 15 (V/μm) to establish a surface potential of the electrophotographic photosensitive member into a given value E(V) and subsequently the surface of the electrophotographic photosensitive member is exposed to light under conditions that the electrophotographic photosensitive member has a surface potential of 0.8 E(V) at a time point that T(ms) passes after exposure starts, an inclination of the light attenuation curve at a time point that T(ms) passes after exposure starts is represented by m; and in a dark-time surface potential attenuation curve drawn in a way in which the surface of the electrophotographic photosensitive member is charged under conditions that the electrophotographic photosensitive member has a surface potential of 0.8 E(V) at a time point that T(ms) passes after charging is finished and thereafter no exposure is performed, an inclination of the dark-time surface potential attenuation curve at a time point that T(ms) passes after charging is finished is represented by m', m and m' satisfy the following expression (I):

$$|m-m'|\leqq 0.020 \quad \text{(I)},$$

provided that $T=((d^2/(\mu\times E))\times 100)\times 10^{-5}$, where d is the layer thickness (μm) of the charge transport layer and μ is a drift mobility ($cm^2/(V.s)$) of the charge transport layer, wherein where the electron affinity of the electron-transporting material contained in said charge generation layer is represented by $E_A$ and the electron affinity of the charge-generating material in the charge generation layer is represented by $G_A$, $E_A$ and $G_A$ satisfy the following expression III:

$$-0.20\leqq(E_A-G_A)\leqq 0.20 \quad \text{(III)}$$

wherein the charge generation layer is in a layer thickness from 0.01 mm to 2 mm, and wherein the electron-transporting material in the charge generation layer is in a proportion from 10% to 60% by weight based on the weight of the charge-generating material in the charge generation layer.

2. The electrophotographic photosensitive member according to claim 1, wherein said m and said m' satisfy the following expression (II):

$$|m-m'|\leqq 0.015 \quad \text{(II)}.$$

3. The electrophotographic photosensitive member according to claim 1, wherein said $E_A$ and said $G_A$ satisfy the following expression (IV):

$$-0.10\leqq(E_A-G_A)\leqq 0.20 \quad \text{(IV)}.$$

4. The electrophotographic photosensitive member according to claim 3, wherein said $E_A$ and said $G_A$ satisfy the following expression (V):

$$0<(E_A-G_A)\leqq 0.20 \quad \text{(V)}.$$

5. The electrophotographic photosensitive member according to claim 1, wherein said charge generation layer contains an electron-transporting material having reduction potential in the range of from −0.50 V to −0.30 V.

6. The electrophotographic photosensitive member according to claim 1, wherein the hole-transporting material has an oxidation potential in the range of from 0.70 V to 0.80 V.

7. A process cartridge comprising the electrophotographic photosensitive member according to claim 1, and at least one means selected from the group consisting of a charging means, a developing means, a transfer means and a cleaning means, which are held together; the process cartridge being detachably mountable to a main body of an electrophotographic apparatus.

8. An electrophotographic apparatus comprising the electrophotographic photosensitive member according to claim 1, a charging means, an exposure means, a developing means and a transport means.

9. An electrophotographic apparatus according to claim 8, wherein said exposure means is a means for forming a digital latent image upon irradiation of the surface of said electrophotographic photosensitive member with laser light.

* * * * *